US006516862B2

(12) United States Patent
Klein

(10) Patent No.: US 6,516,862 B2
(45) Date of Patent: Feb. 11, 2003

(54) METHOD OF FABRICATING A MOLD-CAST POROUS METAL STRUCTURE

(75) Inventor: John F. Klein, Port Washington, NY (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 09/822,689

(22) Filed: Mar. 30, 2001

(65) Prior Publication Data

US 2002/0139504 A1 Oct. 3, 2002

(51) Int. Cl.[7] ..... B22D 11/16; B22D 27/04; B22D 23/00

(52) U.S. Cl. ..... 164/4.1; 164/79; 164/452; 164/154.3; 164/154.6; 164/154.8; 164/122.1; 164/66.1

(58) Field of Search ..... 164/4.1, 79, 452, 164/154.1, 154.3, 154.6, 154.8, 122.1, 66.1, 259, 338.1

(56) References Cited

U.S. PATENT DOCUMENTS

| | | | | | |
|---|---|---|---|---|---|
| 3,720,103 | A | * | 3/1973 | Adams et al. | 73/190 H |
| 4,579,166 | A | | 4/1986 | Neelameggham et al. | 164/458 |
| 4,671,342 | A | | 6/1987 | Balevski et al. | 164/458 |
| 4,673,025 | A | | 6/1987 | Mortimer | 164/457 |
| 4,907,177 | A | | 3/1990 | Curreri et al. | 364/557 |
| 4,952,780 | A | | 8/1990 | Curreri et al. | 219/390 |
| 4,976,305 | A | | 12/1990 | Tanaka et al. | 164/458 |
| 5,111,870 | A | | 5/1992 | Cook | 164/61 |
| 5,181,549 | A | * | 1/1993 | Shapovalov | 164/79 |
| 5,348,071 | A | | 9/1994 | Cook | 164/61 |
| 5,398,745 | A | | 3/1995 | Cook | 164/66 |
| 5,540,271 | A | | 7/1996 | Cook | 164/61 |
| 5,597,032 | A | | 1/1997 | Marrien | 164/457 |
| 6,019,837 | A | * | 2/2000 | Maeda et al. | 117/14 |
| 6,250,362 | B1 | * | 6/2001 | Rioja et al. | 164/46 |

* cited by examiner

*Primary Examiner*—Tom Dunn
*Assistant Examiner*—I. H. Lin
(74) *Attorney, Agent, or Firm*—Stetina Brunda Garred & Brucker

(57) ABSTRACT

A method of fabricating a porous metal structure of a molten liquid metal within a casting chamber to form a porous solid structure upon controlled chamber cooling and depressurization. The method includes provision of a pressurizable stationary mold casting chamber having a gas pressure release valve, a gas pressure measurement sensor, and a plurality of sites with respective surface-temperature or heat flux sensors and respective independently operable temperature controllers for regulating each respective site temperature. A data base driven microprocessor receives pressure and temperature data and selectively and independently adjusts pressure and temperature in accord with algorithmic commands relative required pressure reduction for pore formation and cooling for solidification to chosen extents of porosity and of solidification over a time period terminating upon porous solid-structure fabrication.

11 Claims, 2 Drawing Sheets

METHOD OF FABRICATING A MOLD-CAST POROUS METAL STRUCTURE

STATEMENT RE: FEDERALLY SPONSORED RESEARCH/DEVELOPMENT (Not Applicable)

CROSS-REFERENCE TO RELATED APPLICATIONS (Not Applicable)

BACKGROUND OF THE INVENTION

The present invention relates in general to the production of mold-cast structures, and in particular to a method for controlling solidification rate and pore formation of a molten liquid metal within a mold casting chamber by measuring and regulating soluble-gas pressure within the chamber and temperature and/or heat flow change at a plurality of chamber sites to thereby fabricate a solid porous metal structure having known characteristics produced as a result of such chosen pressure and temperature regulation.

Production of numerous products is accomplished through employment of mold fabrication technology whereby hot liquid material constituting the substance of a finished product is placed within a mold chamber shaped in the form of the desired final product and thereafter cooled to solidify and yield the finished product. Eligible materials for moldable products generally must be able to withstand heating to a flowable liquid state without untoward breakdown of components and to ultimately cool after formation into an acceptable product. Two typical families of such materials are found in plastics and metals, thereby resulting in various plastic polymers and feasibly-meltable metals being mold-formed into a myriad of products.

While the generalized steps of heating a material to melt, introducing the molten material to a mold cavity, and cooling the material to form a finished product are well known, specific procedures and methodology during these steps can significantly contribute to end product results. Thus, for example, the rate of cooling and thus solidification of particular molten metals can affect the microstructure of the finished metal structure. One prior art attempt to regulate cooling includes actual movement of a mold cavity having therein the metal through a series of decreasing temperature zones to thereby produce a general, and obviously non-precise, cooling effect over a period of time. Another prior art attempt to regulate cooling is a simple reduction of heat to the mold cavity in a non-precise manner. While solid structure formation of a molded product readily occurs through these prior art methods, the actual microstructure of the product is not standardized because consistency of cooling and therefore consistency of the solidification rate is not achieved.

In addition to forming solid structures in general, it many times is desirous to form solid structures, such as metal structures for example, that have internal porosities to thereby provide weight and structural characteristics congruent with particular product applications. One known procedure for providing pores within a mold-fabricated metal structure is to force a soluble gas such as hydrogen under pressure into molten metal, as shown for example in U.S. Pat. No. 5,181,549 to Shapovalov. Dissolved-gas behavior is such that its solubility decreases with decreasing temperature and decreasing pressure, thereby simultaneously responding to two separate parameters that influence activity. During cooling and/or depressurization, the dissolved gas precipitates and goes to bubbles that do not leave, but, instead, form pores. While the prior art recognizes such gas behavior in porosity formation, the prior art does not teach methodology employing precision parameter measurement followed by precision parameter adjustment for controlled structural formation.

In view of the short comings noted above, it is apparent that a need is present for a method of providing significant control over solidification rates along with internal pore formation of structures formed within a mold casting chamber. Accordingly, a primary object of the present invention is to provide a method of controlling a solidification rate of a molten liquid metal within a casting chamber of a mold while additionally controlling pore formation within the metal by continuously monitoring and adjusting pressure within the chamber and continuously monitoring and adjusting temperature values at a plurality of sites relative the casting chamber.

Another object of the present invention is to provide a method of controlling such porosity and rate of solidification wherein a microprocessor determines and accordingly regulates pressure within the chamber and temperature values at each such site in concordance with stored pressure and temperature measurements relating to respective extents of pore formation and solidification.

These and other objects of the present invention will become apparent throughout the description thereof which now follows.

SUMMARY OF THE INVENTION

The present invention is a method of fabricating a porous metal structure from a molten liquid metal within a casting chamber of a mold upon controlled cooling thereof. The method first comprises providing a stationary mold comprising a gas-pressurizable casting chamber with a heat-transferable wall having a plurality of sites each having in communication therewith a respective surface-temperature sensor for determining a respective temperature at each such site. Each site additionally includes an independently operable temperature controller for regulating each respective site temperature. The mold is provided with a gas pressure release valve for releasing gas from the casting chamber and an internal gas pressure measurement sensor for measuring chamber pressure. The method next includes providing a microprocessor comprising first a plurality of stored temperature measurements relating to respective extents of solidification of molten liquid metal at each of the plurality of stored temperature measurements, and second a plurality of stored gas pressure measurements relating to respective extents of solubilized gas molecules within the molten liquid metal for determining porosity thereof. The microprocessor is in communication with each respective surface-temperature sensor for receiving each respective temperature at each site, in communication with each respective temperature controller for selective operation thereof, in communication with said gas pressure measurement sensor for receiving pressure magnitude within the casting chamber, and in communication with the gas pressure release valve for selective operation thereof. The casting chamber is heated to a temperature sufficient to maintain the liquid metal in a molten state, and the molten liquid metal is situated within the casting chamber. A gas at least partially soluble in the molten metal is introduced thereto under pressure of a magnitude sufficient to force a sufficient quantity of solubilized gas molecules into the molten metal for forming pores upon cooling thereof to a porous metal structure. Finally, the microprocessor is activated for receiving each respective temperature at each site and pressure magnitude within the chamber, comparing each respective temperature and pressure magnitude to the stored temperature and pressure measurements, and regulating in response thereto the gas pressure release valve and each respective temperature controller for continuously maintaining a magnitude of pressure and rate of cooling within the casting chamber equal to chosen extents of porosity and solidification over a time period terminating upon fabrication of the porous metal structure.

In a second preferred embodiment, pressure control is identical to that of the first embodiment while the surface-temperature sensors are replaced with or provided in conjunction with heat flux sensors for determining a respective heat removal rate at each site. In addition to stored depressurization rates, the microprocessor includes a plurality of stored heat removal rates relating to respective extents of solidification of liquid metal at each of these stored heat removal rates. The activated microprocessor receives each respective heat removal rate at each site, compares each heat removal rate to the stored heat removal rates, compares and correlates depressurization rates, and regulates in response thereto the pressure relief valve and each respective temperature controller for continuously maintaining pore formation and cooling rate again equal to chosen extents of porosity and solidification over a time period terminating upon fabrication of the solid structure.

The methodology here defined permits precision temperature and pressure management in accord with historical parameters as reflected in algorithmic analyses and regulation via the microprocessor to achieve structure development in accord with specified product production.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENTS

Figure 1:
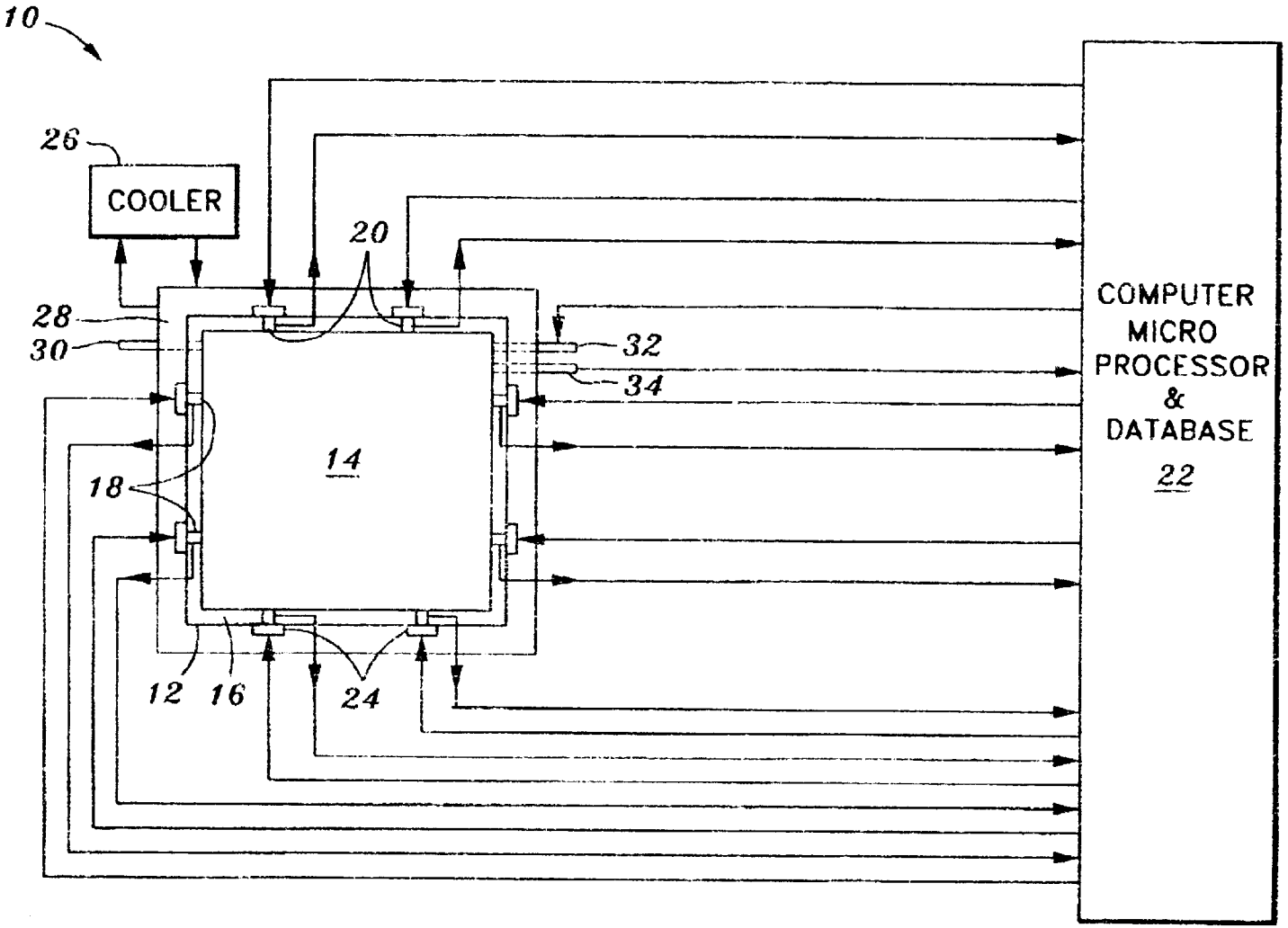
FIG. 1 is a schematic view of a first embodiment of a mold system for regulating formation of a solid structure from a molten metal.

Referring to FIG. 1, a mold system 10 having a stationary mold 12 with a casting chamber 14 therein is illustrated. The.casting chamber 14 is defined by a heat-transferable wall 16 having a plurality of standard surface-temperature sensors 18 in contact with the wall 16 at a plurality of wall sites 20 for determining respective temperatures at each such site 20. Because the wall 16 of the casting chamber 14 is heat transferable, temperatures at each site 20 directly reflect site-associated temperatures within the casting chamber 14. Each sensor 18 is in communication with a standard computer microprocessor 22 for receiving each respective temperature as ascertained by the surface-temperature sensors 18. Also situated in juxtaposed association with each wall site 20 at the location of each sensor 18 are respective heaters non-limitedly exemplified as standard electric heaters 24 functioning as individual temperature controllers at each such site 20. Each heater 24 is in communication with, and operable by, the data base driven microprocessor 22. A temperature-adjustable cooler 26, controlled by the microprocessor 22, distributes cooling fluid air around the wall 16 within encircling ducting 28. A pressurization conduit 30 leads into the chamber 14 for introduction of gas under pressure, while a pressure release valve 32 for releasing gas from the casting chamber and an internal gas pressure measurement sensor 34 for measuring chamber pressure each lead from the chamber 14. The measurement sensor 34 is in communication with the microprocessor 22 for receiving chamber pressure magnitude, while the pressure release valve 32 is in communication with, and operable bye, the microprocessor 22.

Figure 2:
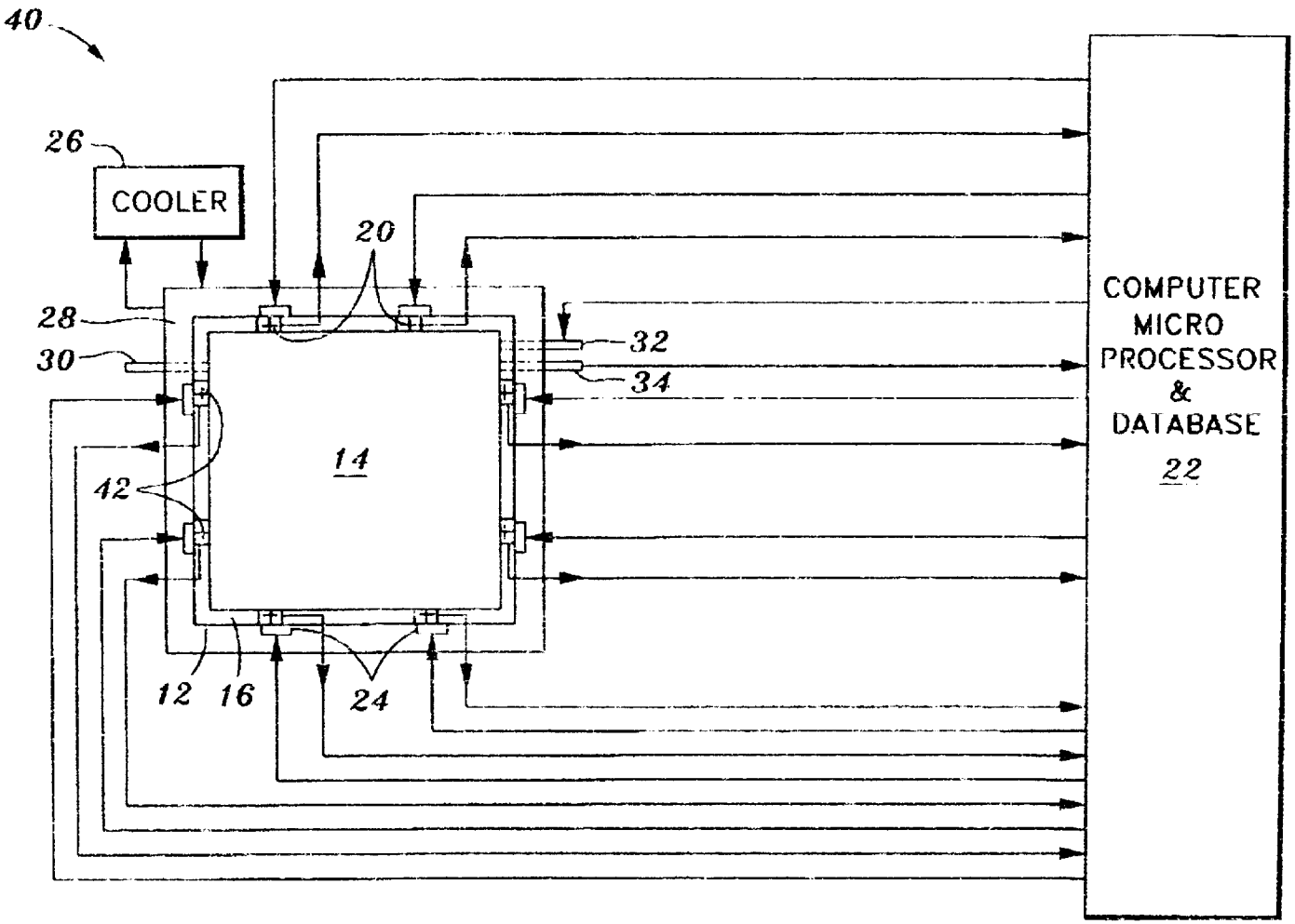
FIG. 2 is a schematic view of a second embodiment of a mold system for regulating formation of a solid structure from a molten metal.

FIG. 2 illustrates a second embodiment of a mold system 40 substantially identical to the embodiment of FIG. 1 except for substitution of respective heat flux sensors 42 in place of surface-temperature sensors 18. Thus, the system 40 has a stationary mold 12 with a casting chamber 14 therein defined by a heat-transferable wall 16. The wall 16 has a plurality of heat flux sensors 42 in contact with the wall 16 at a plurality of wall sites 20 for determining respective heat removal rates at each such site 20. Each sensor 42 is in communication with the computer microprocessor 22 for receiving each respective heat removal rate as ascertained by the heat flux sensors 42. Also situated, as in the embodiment of FIG. 1, in juxtaposed association with each wall site 20 at the location of each sensor 42 are respective heaters 24 functioning as individual temperature controllers at each such site 20. Each heater 24 is in communication with, and operable by, the microprocessor 22. Once again, a cooler 26, powerable by the microprocessor 22, distributes cooling fluid around the wall 16 within encircling ducting 28. As in the embodiment of FIG. 1, a pressurization conduit 30 leads into the chamber 14, while a pressure release valve 32 and internal gas pressure measurement sensor 34 each lead from the chamber 14. In the same manner as above described, the measurement sensor 34 is in communication with the microprocessor 22 while the pressure release valve 32 is in communication with, and operable by, the microprocessor 22.

In operation of the embodiment of FIG. 1, the data base of the microprocessor 22 is programmed with an algorithm embodying a plurality of stored temperature measurements each relating to respective extents of solidification of liquid metal at each of such stored temperature measurements, and an algorithm embodying a plurality of stored gas pressure measurements relating to respective extents of solubilized gas molecules within the molten liquid metal for determining porosity thereof. Product fabrication begins by first heating the casting chamber 14 to a temperature sufficient to maintain the liquid metal in a molten state and thereafter providing the molten metal within the chamber 14. As is apparent, the temperature for a molten state is determined by the metal to be molded. The metal can be heated to the molten state either in the casting chamber 14 or within a separate vessel from which it is transferred to the chamber 14. When the molding process is begun, the microprocessor 22 receives respective temperatures from the surface-temperature sensors 18 at each respective wall site 20 and pressurization value within the chamber 14 from the gas pressure measurement sensor 34, and compares these temperatures and pressurization to stored temperature and pressure measurements for the metal. As required to meet proper solidification rates and pore formation, the microprocessor 22 continuously individually monitors, activates, and deactivates the heaters 24 while also continuously monitoring pressure and opening and closing the pressure release valve 32 to uniformly regulate temperature reduction within the casting chamber 14 as correlated to pressure reduction in achieving desired porosity presence. While the cooler 26 is optional, and without it the ambient temperature in conjunction with activation control of the heaters 24 would function to cool the casting chamber 14, inclusion of the cooler 26 with a constant cooling output enhances standardized ambient conditions to thereby allow greater operating precision of the respective heaters 24 in the control of metal solidification through cooling. Ultimately, the liquid metal within the casting chamber 14 cools to a solid porous structure shaped identically to the casting chamber 14, and is thereafter removed from the chamber 14.

Operation of the embodiment exemplified in FIG. 2 is substantially identical to that of FIG. 1 except for modifications relating to heat flux measurement as opposed to temperature measurement. Thus, the microprocessor 22 is programmed with an algorithm embodying a plurality of stored heat removal rates each relating to respective extents of solidification of liquid metal at each of such stored heat removal rates. Algorithmic programming for pressurization is as described above for the embodiment of FIG. 1. When the molding process is begun, the microprocessor 22 receives respective heat removal rates from the heat flux sensors 42 at each respective wall site 20 and compares these heat removal rates to stored rates for the metal. As required to meet proper solidification rates, the microprocessor 22 continuously individually monitors, activates, and deactivates the heaters 24 to uniformly regulate temperature reduction within the casting chamber 14. Pressurization control again continues identically as earlier described for the first embodiment. Ultimately, in like manner to the embodiment of FIG. 1, the liquid metal within the casting chamber 14 cools to a solid porous structure in accord with chosen parameters.

EXAMPLE

In accord with the above described methodology, a mold system 10 is employable in the fabrication of a porous metal structure such as an aluminum structure. Specifically, the metal is heated to a molten liquid state in a standard heating vessel while the mold system 10 becomes operational and the casting chamber 14 thereof likewise is heated to the temperature of the molten liquid. Thereafter, the molten liquid is ladled into the casting chamber 14, and the chamber is pressurized with hydrogen gas. Hydrogen gas quantity and pressure is chosen as being known to introduce a sufficient amount of solubilized gas into the molten metal such that precipitation thereof yields desired porosity quantity and distribution. The microprocessor 22 continuously receives and responds first to the respective temperature measurements from all sites 20 as reported by the respective surface-temperature sensors 18, and second to pressurization magnitude as reported from the pressure measurement sensor 34. Algorithmic control of the cooling rate within the casting chamber 14, and thus of the solidification rate of the metal therein, is immediately initiated through the microprocessor 22. In like manner, algorithmic control of the depressurization rate proceeds in correlation to the cooling rate to thereby interrelate structure solidification and attendant pore formation occurring from both temperature and pressure reduction as earlier described. Specifically, the required rate of cooling of the metal from its molten state to its solid state calls for a uniform temperature reduction of per unit of time throughout the entire liquid mass in order to achieve a desired microstructure strength within the finished structure, while the correlated pressure reduction likewise is uniform per unit of time. The microprocessor 22 continuously individually monitors, activates, and deactivates all heaters 24 to uniformly regulate this required temperature reduction within the casting chamber 14 while uniformly opening and closing the pressure relief valve 32 until solidification contemporaneous with pore formation within the metal is complete. Thereafter, the finished porous solid structure is removed from the casting chamber 14. In like manner, in the embodiment employing heat flux sensors, heat removal rate data replaces temperature data, and the microprocessor functions identically to continuously individually monitor, activate, and deactivate all heaters 24 and the pressure relief valve 32 to uniformly regulate the algorithmic-required heat removal and pressure reduction rates within the casting chamber until the porous solid structure is formed.

The methodology here illustrated accomplishes precision temperature and pressure management, and therefore precision solidification and pore-formation management, in accord with historical parameters as reflected in algorithmic analyses and regulation to thereby fabricate molded porous structures exhibiting chosen specific structural development. While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A method of fabricating a porous metal structure, the method comprising:

(a) heating a casting chamber to a chamber temperature above a chamber ambient temperature and to a temperature sufficient to maintain a metal in a molten state;

(b) providing a molten metal having a temperature above the chamber ambient temperature into the chamber;

(c) introducing a gas soluable within the molten metal into the chamber at a chamber pressure sufficient to dissolve the gas into the molten metal;

(d) regulating cooling rate of the chamber to decrease the chamber temperature at a rate below ambient cooling rate so as to form a solidification front within the metal capable of progressing throughout the molten metal at a rate slower than a rate achieveable through ambient cooling; and (e) controlling the chamber pressure for forming pores within the structure until the solidification front progresses throughout the structure.

2. The method of fabricating the porous metal structure of claim 1 wherein the regulating step is accomplished with at least two independently controlled heaters to govern the cooling rate to achieve a desired porosity at a selected depth.

3. The method of fabricating the porous metal structure of claim 2 wherein the regulating step to decrease the chamber temperature is accomplished with a forced cooling unit in conjunction with the independently controlled heater(s) for precise solidification front control.

4. The method of fabricating the porous metal structure of claim 3 wherein the injecting energy step is accomplished by activating the independently controlled heaters and forced cooling unit in response to a sensed chamber temperature.

5. The method of fabricating the porous metal structure of claim 4 wherein the chamber temperature is sensed at least at one wall of the chamber with a temperature sensor.

6. The method of fabricating the porous metal structure of claim 5 wherein the controlling step is accomplished with a pressure release valve and a pressurized gas supply in response to a sensed gas pressure.

7. The method of fabricating the porous metal structure of claim 6 further comprising a step (f) regulating steps (d) and (e) based on a solidification front position determined by comparing a current collective historical data of sensed chamber temperature and current sensed gas pressure data with past respective data stored in a microprocessor.

8. The method of fabricating the porous metal structure of claim 3 wherein the regulating step is accomplished by activating the independently controlled heaters and forced cooling unit in response to a sensed heat removal rate.

9. The method of fabricating the porous metal structure of claim 8 wherein the heat removal rate is sensed at least at one wall of the chamber with a heat flux sensor.

10. The method of fabricating the porous metal structure of claim 9 wherein the controlling step is accomplished with a pressure release valve and a pressurized gas supply in response to a sensed gas pressure.

11. The method of fabricating the porous metal structure of claim 10 further comprising a step (f) regulating steps (d) and (e) based on a solidification front position determined by comparing a current collective historical data of sensed heat removal rate and current sensed gas pressure data with past respective data stored in a microprocessor.

* * * * *